US008979323B2

(12) United States Patent
de Bevilacqua

(10) Patent No.: US 8,979,323 B2
(45) Date of Patent: Mar. 17, 2015

(54) LED LIGHTING DEVICE HAVING LIGHT EMITTING AND POWER CIRCUITRY INTEGRATED WITHIN A CASING

(76) Inventor: Carlotta Francesca Isolina Maria de Bevilacqua, Milan (IT)

( * ) Notice: Subject to any disclaimer, the term of this patent is extended or adjusted under 35 U.S.C. 154(b) by 327 days.

(21) Appl. No.: 13/083,318

(22) Filed: Apr. 8, 2011

(65) Prior Publication Data

US 2011/0273885 A1 Nov. 10, 2011

(30) Foreign Application Priority Data

Apr. 9, 2010 (IT) ..... MI2010A0609

(51) Int. Cl.

| | |
|---|---|
| ***F21V 5/00*** | (2006.01) |
| ***F21V 21/00*** | (2006.01) |
| ***F21V 21/30*** | (2006.01) |
| ***F21V 15/01*** | (2006.01) |
| ***F21V 21/34*** | (2006.01) |
| ***F21V 29/00*** | (2006.01) |
| *F21Y 101/02* | (2006.01) |
| *F21Y 105/00* | (2006.01) |

(52) U.S. Cl.

CPC ..... *F21V 21/30* (2013.01); *F21V 15/01* (2013.01); *F21V 15/011* (2013.01); *F21V 21/34* (2013.01); *F21V 29/242* (2013.01); *F21V 29/246* (2013.01); *F21V 5/007* (2013.01); *F21Y 2101/02* (2013.01); *F21Y 2105/001* (2013.01)

USPC ..... 362/311.02; 362/249.02

(58) Field of Classification Search

CPC ... F21V 23/004; F21V 23/005; F21V 19/003; F21V 19/045

USPC ..... 362/373, 294, 218, 249.02, 311.02, 362/646, 631

See application file for complete search history.

(56) References Cited

U.S. PATENT DOCUMENTS

| | | | | |
|---|---|---|---|---|
| 6,924,973 | B2 * | 8/2005 | Kim | 361/728 |
| 7,815,338 | B2 * | 10/2010 | Siemiet et al. | 362/218 |
| 7,878,683 | B2 * | 2/2011 | Logan et al. | 362/249.02 |
| 7,887,218 | B2 * | 2/2011 | Wang | 362/240 |
| 7,909,489 | B2 * | 3/2011 | Lin et al. | 362/373 |

(Continued)

FOREIGN PATENT DOCUMENTS

| | | | |
|---|---|---|---|
| DE | 2531968 | A1 | 2/1977 |
| EP | 1998107 | A1 | 12/2008 |

(Continued)

OTHER PUBLICATIONS

European Search Report of EP 11 16 1969 Dated Aug. 4, 2011.

(Continued)

*Primary Examiner* — Robert May

(74) *Attorney, Agent, or Firm* — Vector IP Law Group; Robert S. Babayi

(57) ABSTRACT

A LED lighting device comprising a casing, which houses a plurality of power LEDs set on a LED-carrier board; and a plurality of optical elements positioned in front of respective LEDs; the casing is formed by a first half-shell and a second half-shell joined along respective peripheral edges; the first half-shell is made of light permeable material and has a front plate facing the LEDs which constitutes a light emission plate; the second half-shell is made of heat conductive, light impermeable material and has a rear wall, onto which the board is applied and which constitutes a heat dissipation plate opposite to the light emission plate.

11 Claims, 2 Drawing Sheets

(56) References Cited

U.S. PATENT DOCUMENTS

| | | | | |
|---|---|---|---|---|
| 7,914,162 | B1 * | 3/2011 | Huang | 362/92 |
| 2002/0044446 | A1 | 4/2002 | Layne et al. | |
| 2002/0191396 | A1 | 12/2002 | Reiff et al. | |
| 2005/0152146 | A1 * | 7/2005 | Owen et al. | 362/294 |
| 2005/0276045 | A1 | 12/2005 | Kovacik et al. | |
| 2006/0034070 | A1 | 2/2006 | Kovacik et al. | |
| 2006/0034078 | A1 | 2/2006 | Kovacik et al. | |
| 2006/0285325 | A1 | 12/2006 | Ducharme et al. | |
| 2009/0180284 | A1 * | 7/2009 | Lin et al. | 362/294 |
| 2009/0219713 | A1 | 9/2009 | Siemiet et al. | |
| 2011/0103051 | A1 * | 5/2011 | Wilcox et al. | 362/235 |
| 2011/0211352 | A1 * | 9/2011 | Reingruber | 362/249.02 |

FOREIGN PATENT DOCUMENTS

| | | | |
|---|---|---|---|
| WO | WO 2006/102757 | A1 | 10/2006 |
| WO | WO-2006102757 | A1 | 10/2006 |
| WO | WO 2006/122392 | A1 | 11/2006 |
| WO | WO-2006122392 | A1 | 11/2006 |
| WO | WO 2010020497 | A1 * | 2/2010 |

OTHER PUBLICATIONS

Italian Search Report No. IT MI20100609, dated Nov. 17, 2010.

* cited by examiner

LED LIGHTING DEVICE HAVING LIGHT EMITTING AND POWER CIRCUITRY INTEGRATED WITHIN A CASING

The present invention relates to a LED lighting device.

BACKGROUND OF THE INVENTION

It is known that LED lighting sources are increasingly common in the lighting sector. However, the use of LEDs still displays some drawbacks that the known lighting devices have not yet completely solved.

For example, if making of relatively small lighting apparatuses with high lighting capacity is desired, an adequate number of lighting sources and an adequate space for installing the supply and control assembly of the sources must be provided. It is not thus possible, in general, to make particularly compact apparatuses, e.g. very thin ones, unless the supply and control assembly is housed outside the apparatus.

On the other hand, in the lighting sector, the search for technical solutions which also allow to obtain new concept lighting effects is constant, being in this sector fundamental not only the solely functional aspect but also the aesthetic and emotional component.

Ultimately, the known devices appear improvable, particularly in terms of construction simplicity, efficiency, dimensions, and versatility (i.e. capacity of providing original lighting effects).

SUMMARY OF THE INVENTION

It is an object of the present invention to provide a LED lighting device which is, with respect to the known solutions, at least equally or more efficient, simple and versatile, as well as capable of providing particular lighting effects, being further extremely compact.

The present invention thus relates to a LED lighting device as disclosed in essential terms in the accompanying claim 1 and in the additional features thereof which are disclosed in the dependent claims.

The device of the invention is simple to make and install, fully efficient, reliable and very versatile, allowing to obtain particular lighting effects; the apparatus of the invention may further have a very small size while housing the electric and electronic supply and control components of the LEDs inside.

BRIEF DESCRIPTION OF THE DRAWINGS

Further features and advantages of the present in invention will be apparent in the description of the following non-limitative examples of embodiment, with reference to the accompanying drawings, in which.

DETAILED DESCRIPTION OF THE INVENTION

Figure 2:
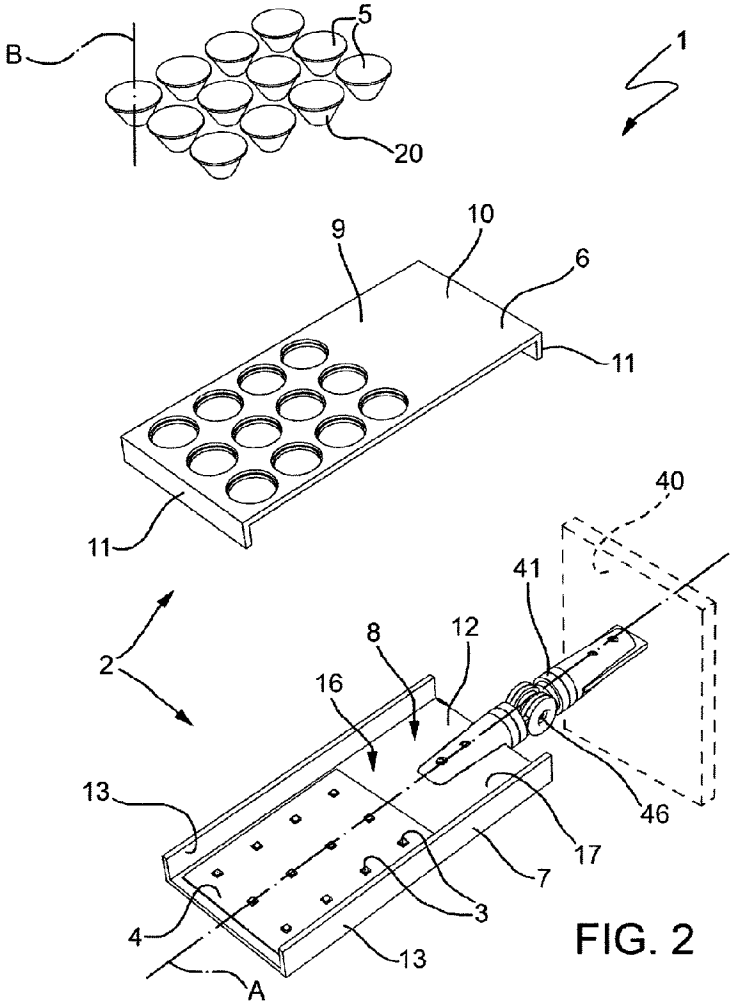
FIG. 2 is a partially exploded, diagrammatic view with parts removed for clarity of the device in FIG. 1.

With reference to the accompanying figures, a LED lighting device 1 comprises a casing 2, a plurality of power LEDs 3 fixed to a LED-carrier plate 4, and a plurality of optical elements 5 arranged facing respective LEDs 3.

The casing 2 extends substantially along an axis A and is formed by two half-shells 6, 7 joined to one another on opposite sides of axis A and internally defining a chamber 8 inside the casing 2, in which the board 4, the LEDs 3 and the optical elements 5 are housed.

A first half-shell 6 is made of light permeable material and/or comprises at least one front wall 9, facing the LEDs 3 and which covers or surrounds the optical elements 5 and constitutes a light emission plate 10, made of light permeable material.

In the preferred embodiment shown, the half-shell 6 is substantially C-shaped having a cross section orthogonal to axis A, C-shaped; the half-shell 6 further comprises, in addition to the front wall 9, a pair of facing and parallel sides 11, which extend from respective sides opposite to the front wall 9 and are substantially orthogonal to the front wall 9.

The second half-shell 7 is made of heat conductive, light impermeable material and/or comprises at least one rear wall 12, facing the front wall 9 of the half-shell 6, made of heat conductive, light impermeable material.

In the preferred embodiment shown, the half-shell 7 is also substantially C-shaped; the half-shell 7 has a longitudinal section parallel to axis A, C-shaped; the half-shell 7 comprises, in addition to the rear wall 12, a pair of sides 13 facing and parallel, which extend from respective side edges opposite to the rear wall 12 and are substantially orthogonal to the rear wall 12.

The board 4 is arranged on an inner face 16, facing the chamber 8 and the front wall 9, of the rear wall 12; the rear wall 12 constitutes a heat dissipation plate 17 opposite to the light emission plate 10.

Advantageously, the first half-shell 6 is made of polymeric material and the second half-shell 7 is made of aluminum; or, the second half-shell 7 or at least the rear wall 12 thereof, are made of ceramic material.

The sides 11, 13 of each of the half-shells 6, 7 are substantially orthogonal to the sides of the other half-shell and are inserted between the sides of the other half-shell.

The two half-shells 6, 7 are joined to form the casing 2 along respective peripheral edges.

The two half-shells 6, 7 are joined to each other mechanically, e.g. by means of screws or other fastening elements, or in other known manner, e.g. welded, glued etc.

The board 4 is applied directly onto the inner face 16 of the heat dissipation plate 17, i.e. onto the rear wall 12, facing the light emitting plate 10.

The optical elements 5 are, for example (but not necessarily), total internal reflection lenses; each optical element 5 has an optical body 20, which extends along and about an optical axis A between two opposite axial ends provided, respectively, with an inlet surface 21, facing a LED 3, and an outlet surface 22, either facing the light emission plate 10 or inserted therein. The optical axes A are parallel to one another and substantially perpendicular to the light emission plate 10.

The side wall 12 constitutes the heat dissipation plate 17 on which the board 4 is directly applied as indicated, made of heat conductive material, e.g. aluminum or ceramic material, so as to effectively dispose the heat generated by the LEDs 3 outside the casing 2, without requiring further dissipation structures.

Being made of light permeable (transparent, translucid etc.) material, the half-shell 6 and specifically at least the light emission plate 10 light up when the device 1 is on, collecting the light dispersed by the chamber 8 inside the casing 2.

The device 1 thus provides a lighting effect in which the bright lighting beams exit from the outlet surfaces 22 of the optical elements 5, while the rest of the light emission plate 10 is more weakly illuminated.

Advantageously, the light emission plate 10 is shaped so as to directly support the optical elements 5 and centre each of the optical elements 5 with respect to a LED 3.

Figure 3:
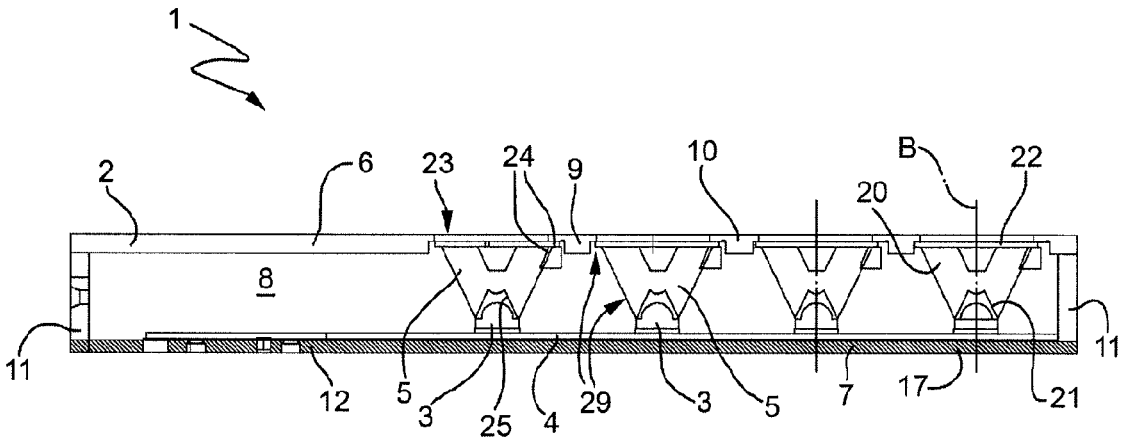
FIG. 3 is a partially exploded, diagrammatic longitudinal section view with parts removed for clarity of the device in FIG. 1.

In particular, as shown in FIG. 3, the light emission plate 10 has seats 23 engaged by respective optical elements 5; the optical elements 5 are mechanically coupled to the seats 23, e.g. by means of fastening elements 24; each optical element 5 is mechanically coupled to a seat 23, preferably in releasable manner, by means of fastening elements 24 shaped directly on the optical body 20 and on the light emission plate 10 and cooperating with one another.

The LEDs 3 are advantageously housed in respective recesses 25 of the optical elements 5.

The light emission plate 10 may have through holes aligned to respective optical elements 5, and through which the optical elements 5 are insertable in the seats 23 and possibly replaceable after releasing the fastening elements 24; or, the emission plate 10 may have a substantially flat, continuous outer surface which covers the optical elements 5.

To increase the amount of light which illuminates the light emission plate 10, gaps 29 from which the light exits are provided between a LED 3 and the optical element 5 associated thereto and/or between the optical elements 5 and the light emission plate 10.

Figure 4:
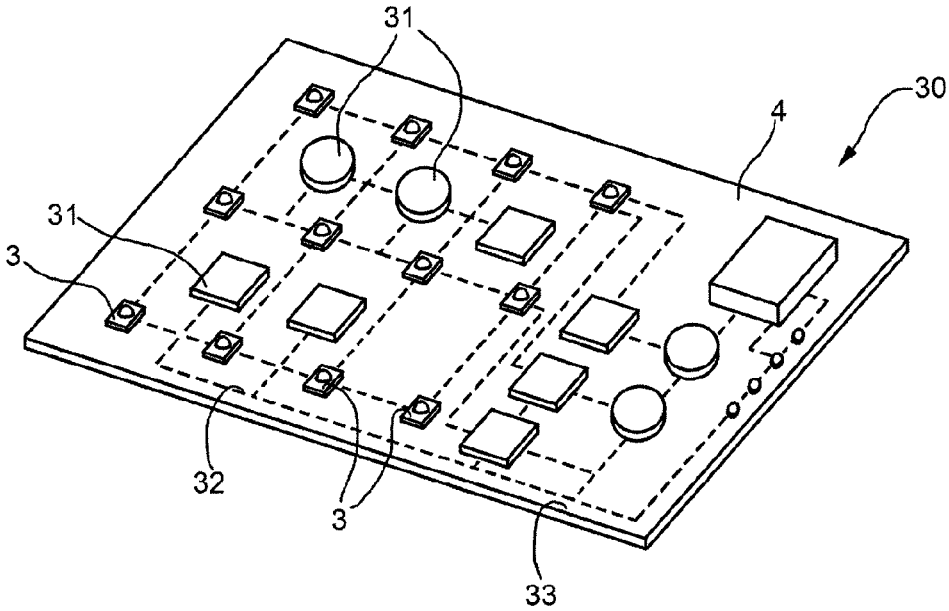
FIG. 4 is a diagrammatic view of an inner detail of the device in FIG. 1.

With particular reference to FIG. 4, the casing 2 also houses a power supply-transformer 30, connectable to an external supply network and adapted to transform the network voltage into a supply voltage for LEDs 3 (typically by reducing the network voltage, 220/230 V, low voltage, 12/24/etc. V); the power supply-transformer 30 is formed by a group of electric and/or electronic components 31 entirely housed in the chamber 8 within the casing 2; at least one of the components 31 of the power supply-transformer 30 are arranged on the board 4, between the LEDs 3 and the optical elements 5.

The LEDs 3 are connected by conductor tracks 32 (only diagrammatically and practically shown in FIG. 4) arranged (e.g. printed) on the board 4; the traces 32 are included in a circuit 33 (preferably a printed circuit) which connects the LEDs 3 and the components 31 of the power supply/transformer 30.

By distributing the components 31 of the power supply-transformer 30 also in the available space on the board 4 between the LEDs 3 and between the optical elements 5, the size of the casing 2 needed to house the entire power supply-transformer 30, and thus the overall dimensions of the device 1, is reduced.

The small size of the device 1 makes it particularly versatile.

Figure 1:
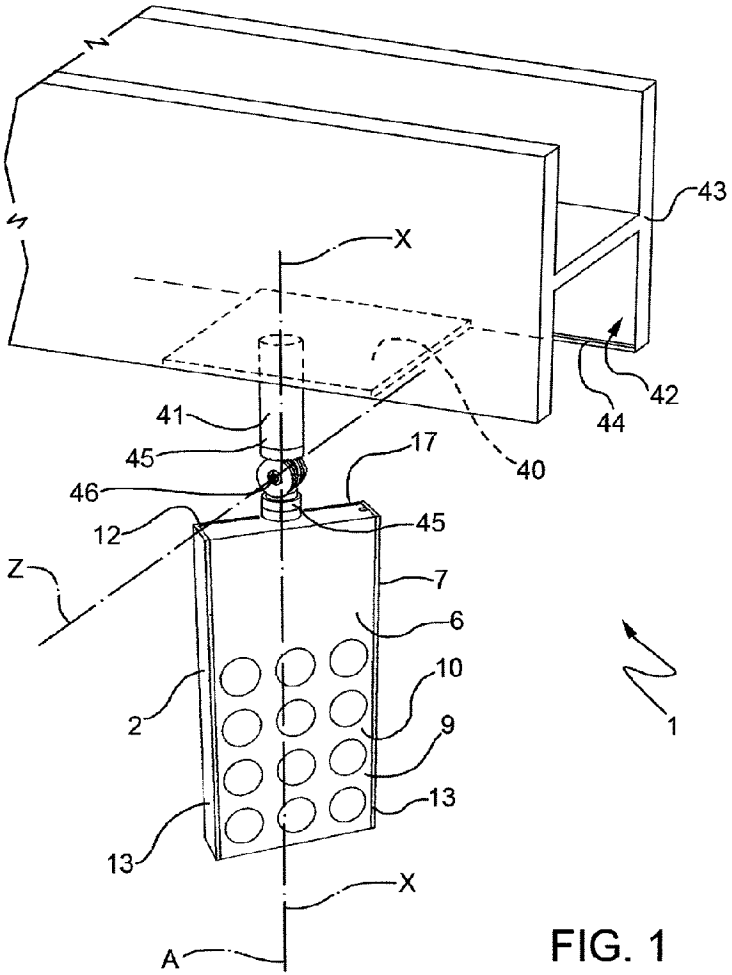
FIG. 1 is a perspective, diagrammatic view of a LED lighting device in accordance with the invention.

In the non-limiting example in FIG. 1, for example, the device 1 is provided with a supporting element 40 and an articulated mechanism 41 which connects the casing 2 to the supporting element 40. The supporting element 40 is housed in a channel 42, formed, for example, by a profile 43, and slides along a guide 44 within the channel 42.

The mechanism 41 is shaped so as to allow the rotation of the casing 2 with respect to the supporting element 40 about at least two rotation axes and preferably about three rotation axes orthogonal to one another.

For example, the mechanism 41 comprises a pair of pins 45, fixed respectively to the supporting element 40 and to the casing 2 and hinged to one another by means of a joint 46; each pin 45 extends along a rotation axis X and is rotational with respect to the joint 46, independently from the other pin 45, about such axis of rotation X; the joint 46 further allows the two pins 45 to turn with respect to one another about a third axis of rotation Z perpendicular to the rotation axes X.

The small size and the presence of the mechanism 41 allow position and orientation of the casing 2 to be changed and also the casing 2 to be concealed inside the channel 42.

It is in all cases understood that the device 1, possibly provided with another suitable supporting element and/or different jointing mechanism, may be used to make other types of lamps (e.g. wall, table, floor lights etc.).

Moreover, it is understood that further changes and variations can be made to the lighting device described and shown herein without departing from the scope of protection of the appended claims.

The invention claimed is:

1. A LED lighting device, comprising a casing, which houses a plurality of power LEDs set on a LED-carrier board; and a plurality of optical elements positioned in front of respective LEDs; the casing comprising a first half-shell having at least one front wall, facing the LEDs which constitutes a light emission plate, made of light permeable material; and a second half-shell, joined to the first half-shell and having at least one rear wall, on which the board is positioned comprising a power supply-transformer, connectable to an external network and adapted to transform the mains voltage into a LED supply voltage; the power supply-transformer being formed by an assembly of a plurality of electric and/or electronic components entirely housed within the casing; wherein at least some each one of the electric and/or electronic components of the power supply/transformer are separately arranged on the board and distributed in the available space on the board, between the LEDs and/or between the optical elements.

2. A device according to claim 1, wherein the first half-shell and the second half-shell are joined along respective peripheral edges to form the casing.

3. A device according to claim 1, wherein the two half-shells are substantially C-shaped having respective pairs of lateral sides facing and parallel to one another; the sides of each half-shell being substantially perpendicular to the sides of the other half-shell and inserted between the sides of the other half-shell.

4. A device according to claim 1, wherein the board is applied directly on an inner face of the heat dissipation plate.

5. A device according to claim 1, wherein the light emission plate is shaped so as to support the optical elements.

6. A device according to claim 1, wherein the light emission plate is provided with seats engaged by respective optical elements.

7. A device according to claim 6, wherein the optical elements are mechanically fastened to respective seats in a releasable manner, by means of fastening elements.

8. A device according to claim 1, wherein gaps are provided between a LED and the optical element associated thereto and/or between an optical element and the light emission plate.

9. A device according to claim 1, wherein the first half-shell is made of polymer material.

10. A device according to claim 1, wherein the second half-shell is made of ceramic material and/or comprises at least one rear wall, which constitutes the heat a heat dissipation plate on which the board is directly applied, made of ceramic material.

11. A device according to claim 1, wherein the plurality of optical elements comprises total internal reflection lenses, having a recessed portion within which an LED is at least partially contained and separated from a respective optical element by a gap that disperses light.

* * * * *